United States Patent [19]

Kishi

[11] 3,999,893

[45] Dec. 28, 1976

[54] COMPRESSOR FOR REFRIGERATING MACHINES

[75] Inventor: Atsuo Kishi, Katsuta, Japan

[73] Assignee: Hitachi, Ltd., Japan

[22] Filed: May 16, 1972

[21] Appl. No.: 253,811

[30] Foreign Application Priority Data

May 17, 1971 Japan ..... 46-32486

[52] U.S. Cl. ..... 417/269

[51] Int. Cl.[2] ..... F04B 1/12

[58] Field of Search ..... 417/269, 269 U, 269 P, 417/269 D, 269 A, 269 E

[56] References Cited

UNITED STATES PATENTS

| | | | |
|---|---|---|---|
| 2,877,653 | 3/1959 | Masnik et al. | 74/60 |
| 2,925,047 | 2/1960 | Hoffer | 417/269 |
| 2,945,444 | 7/1960 | Leissner | 417/269 |
| 3,057,545 | 10/1962 | Ransom et al. | 417/269 |
| 3,085,514 | 4/1963 | Budzich | 417/269 |
| 3,209,701 | 10/1965 | Phinney | 417/269 |
| 3,352,485 | 11/1967 | Niki et al. | 417/269 |
| 3,577,891 | 5/1971 | Katuta-shi | 417/269 |
| 3,712,759 | 1/1973 | Olson | 417/269 |

*Primary Examiner*—William L. Freeh
*Assistant Examiner*—G. P. La Pointe
*Attorney, Agent, or Firm*—Craig & Antonelli

[57] ABSTRACT

A compressor for a refrigerating machine, which is so constracted that a suction passage of the compressor is formed including a crank case of said compressor as part thereof and the sliding portions of said compressor are lubricated by lubricating oil mixed in a refrigerant circulating in a refrigerant circuit.

2 Claims, 11 Drawing Figures

COMPRESSOR FOR REFRIGERATING MACHINES

BACKGROUND OF THE INVENTION

1. Field of the Invention

This invention relates to the lubrication of a compressor for refrigerating machines, and more particularly to a compressor which is designed that the portions need to be lubricated of the compressor are lubricated by lubricating oil mixed in a circulating refrigerant, without providing an oil pan or oil pump.

2. Description of the Prior Art

A refrigeration circuit is generally composed of a compressor, a condenser, a liquid receptacle, an expansion valve, an evaporator and a piping interconnecting said elements, which are arranged such that a refrigerant is compressed by the compressor, cooled and liquefied in the condenser, evaporated in the evaporator upon passing through the liquid receptacle and expansion valve, and then returned to the compressor. The compressor is usually provided with an oil reservoir at the lower portion of a crank case and lubricating oil retained in said oil reservoir is supplied to bearings, a piston and other sliding members as by a gear pump. With such a construction, however, the oil during the suction and compression stages of the compressor is discharged, although in a slight quantity, into the refrigerant passage through the gaps, for example, between the piston and cylinder wall, and finally the oil reservoir is emptied. Therefore, it is usual that the oil is separated from the refrigerant at the suction side of the compressor and returned to the oil reservoir. However, in such a construction, a high negative pressure suddenly appears in the passage on the suction side of the compressor at the start of said compressor, which acts in the oil reservoir via the gap between the piston and cylinder wall or the oil return passage, causing the so-called oil foaming phenomenon in which the lubricating oil bubbles in said oil reservoir. The oil foaming phenomenon causes the oil rapidly to flow into the passage on the suction side through the aforesaid gap or oil return passage, with the result that the oil reservoir is emptied and seizure of bearings or other sliding members results. Furthermore, when the negative pressure appears in the passage on the suction side, the pressure in the oil pan also drops, so that the performance of the gear pump is drastically degraded and the same trouble results. Such phenomenon is unavoidable in the type of compressor in which a fixed quantity of oil is stored in an oil reservoir and supplied to the sliding portions of the compressor by means of a gear pump or the like. This problem may be dealt with by making the oil reservoir larger and increasing the quantity of oil stored in said oil reservoir, but the larger size of oil reservoir makes the size of the compressor larger. This is undesirable particularly for car coolers and air conditioners which are subjected to a limitation in mounting space.

SUMMARY OF THE INVENTION

An object of the present invention, therefore, is to provide a compressor for refrigerating machines, which eliminates the lubricating oil shortage problem at the start and during operation under negative pressure of the compressor.

Another object of the invention is to provide a compressor for refrigerating machines, in which the lubrication and cooling of the portions desired to be lubricated and cooled are effected without requiring an oil reservoir and oil pump.

Still another object of the invention is to provide a compressor for refrigerating machines, which is small in size and can be manufactured at a low cost and be easily mounted even in a limited narrow space.

A further object of the invention is to provide a compressor for refrigerating machines, in which temperature rise within the compressor is uniformalized, and thereby the thermal deformation of the compressor is uniformalized and the occurrence of an abnormal force due to the temperature rise is avoided.

According to the invention there is provided a compressor which is characterized in that a passage on the suction side of the compressor is formed including a crank case of said compressor as part thereof and said passage is communicated with the portions of the compressor desired to be lubricated, so that said portions may be lubricated by a lubricating oil mixed in a refrigerant gas and concurrently cooled by said refrigerant gas further ensuring the prevention of seizure of the sliding members which are heated during operation of the compressor.

DESCRIPTION OF THE PREFERRED EMBODIMENTS

Figure 1:
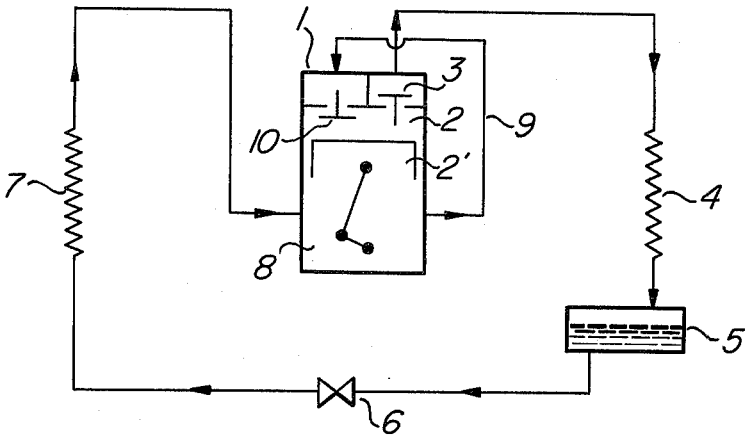
FIG. 1 is a schematic diagram showing a refrigeration circuit including an embodiment of the compressor for refrigerating machines according to the present invention.
Figure 3:
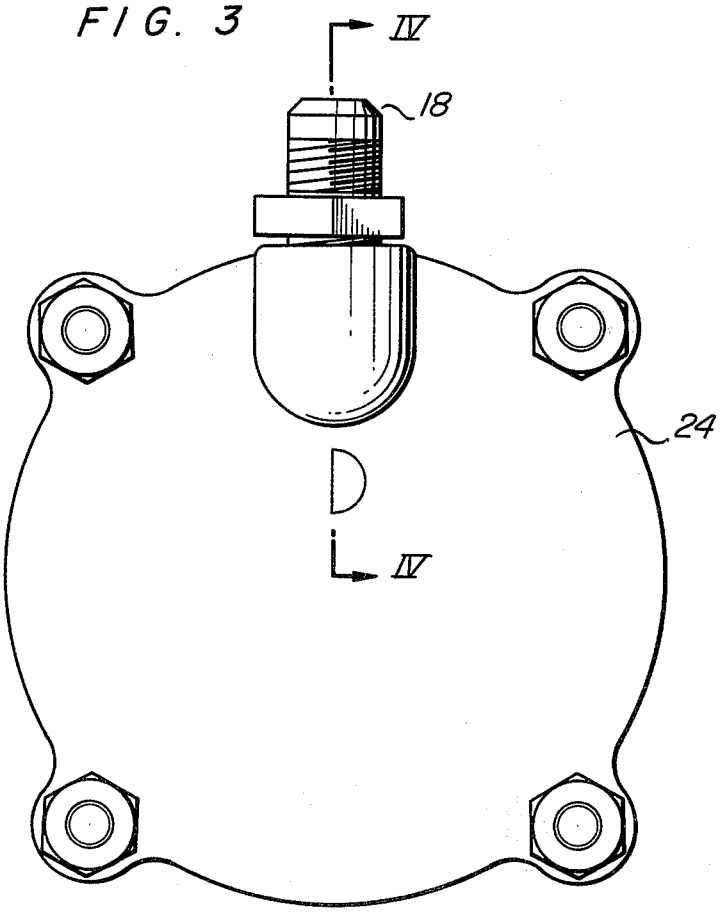
FIG. 3 is a right side elevational view of the compressor shown in FIG. 2.

With reference to the drawings and particularly to FIG. 1 there is shown a refrigeration circuit which comprises a compressor 1 according to an embodiment of the invention, a condenser 4, a liquid receptacle 5, an expansion valve 6 and an evaporator 7. The compressor 1 has a cylinder chamber 2 communicated with the condenser 4 through a discharge valve 3, and a crank case 8. A refrigerant gas sucked into the crank case 8 of the compressor 1 is sucked into the cylinder chamber 2 through a passage 9 and a suction valve 10, after passing the sliding portions of the compressor.

In such a construction, when a small quantity (on the order of 4 to 8 % by weight of refrigerant) of lubricating oil is sealed in the refrigeration circuit together with the refrigerant, the oil constantly flows in the circuit, during operation of the refrigeration cycle, in a quantity proportional to the quantity of circulating refrigerant and is sprayed onto the sliding portions (such as the engaging portions of the cylinder chamber 2 and piston 2') together with the cooled refrigerant gas when said refrigerant gas is sucked into the compressor 1. Thus, the sliding portions are lubricated and cooled sufficiently, only with a small quantity of lubricating oil.

Further, in this case, there is no need of reserving the oil other than in the refrigeration circuit and hence in no case is the quantity of oil, circulating in said circuit, increased temporarily. Therefore, breakage of valves and other troubles, otherwise occurring, can be eliminated. Further, the provision of a gear pump or oil pan becomes unnecessary.

Now, a swash plate compressor embodying the present invention will be described.

Figure 11:
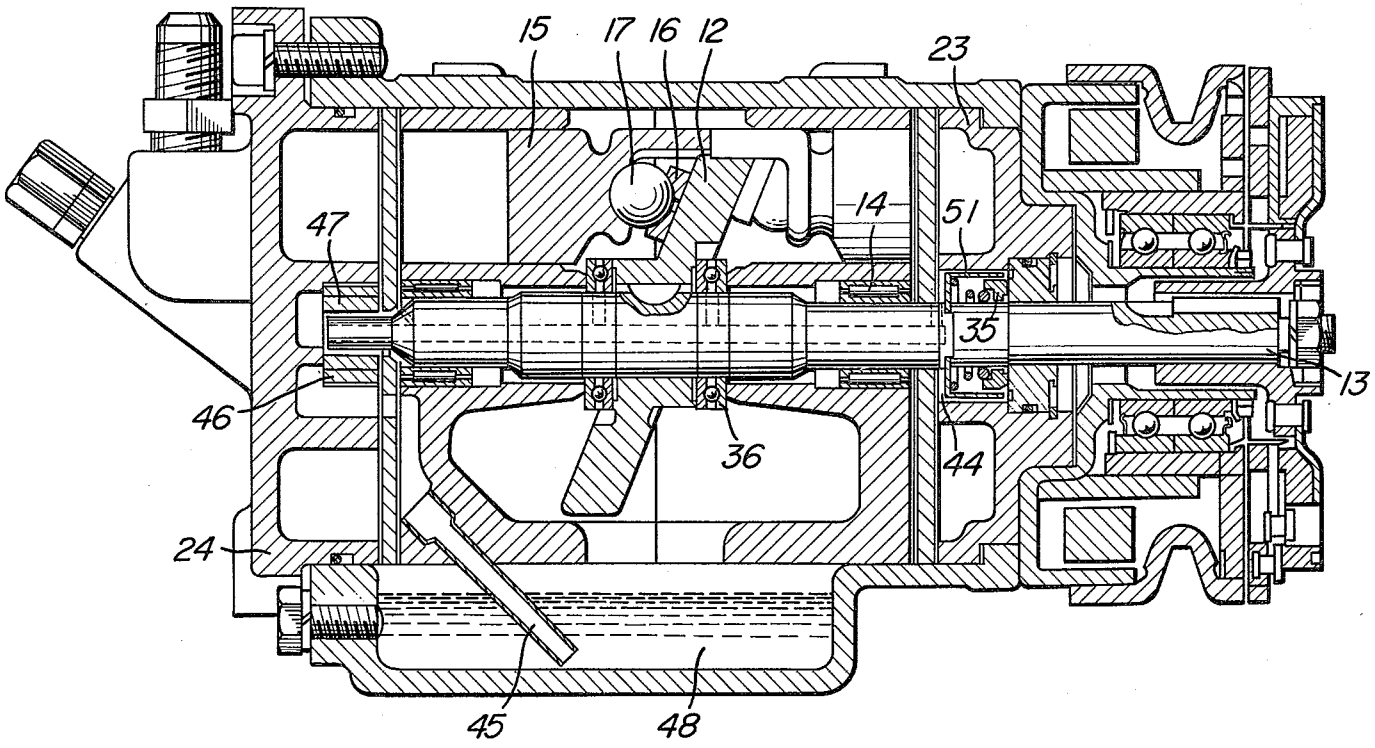
FIG. 11 is a vertical sectional view of a conventional swash plate compressor.

First of all, in a conventional swash plate compressor for refrigerating machines, as shown in FIG. 11, an oil reservoir 48 is provided at the lower portion of the compressor and lubricating oil stored in said oil reservoir is supplied by a gear pump 46 to the sliding portions (the engaging portions of sliding members 16 and a swash plate 12) and bearings 14, 36 for lubricating said portions. A refrigeration circuit including such a compressor is provided with oil separating means to recover the lubricating oil from said refrigeration circuit, which is discharged into said circuit due to the phenomenon described previously, occurring at the start or other times of operation of the compressor. In FIG. 11, reference numeral 44 designates an O-ring, 45 an oil suction pipe and 47 a pump chamber.

The swash plate compressor of the invention is characterized by the fact that an oil reservoir is not provided at the lower portion of the compressor and, instead, oil necessary for the lubrication of the compressor is introduced into the refrigeration circuit and the lubrication of the sliding portions of said compressor by the lubricating oil is effected by fog lubrication, utilizing the energy and low temperature of gaseous refrigerant, whereby the internal construction of the compressor is simplified accordingly.

Figure 2:
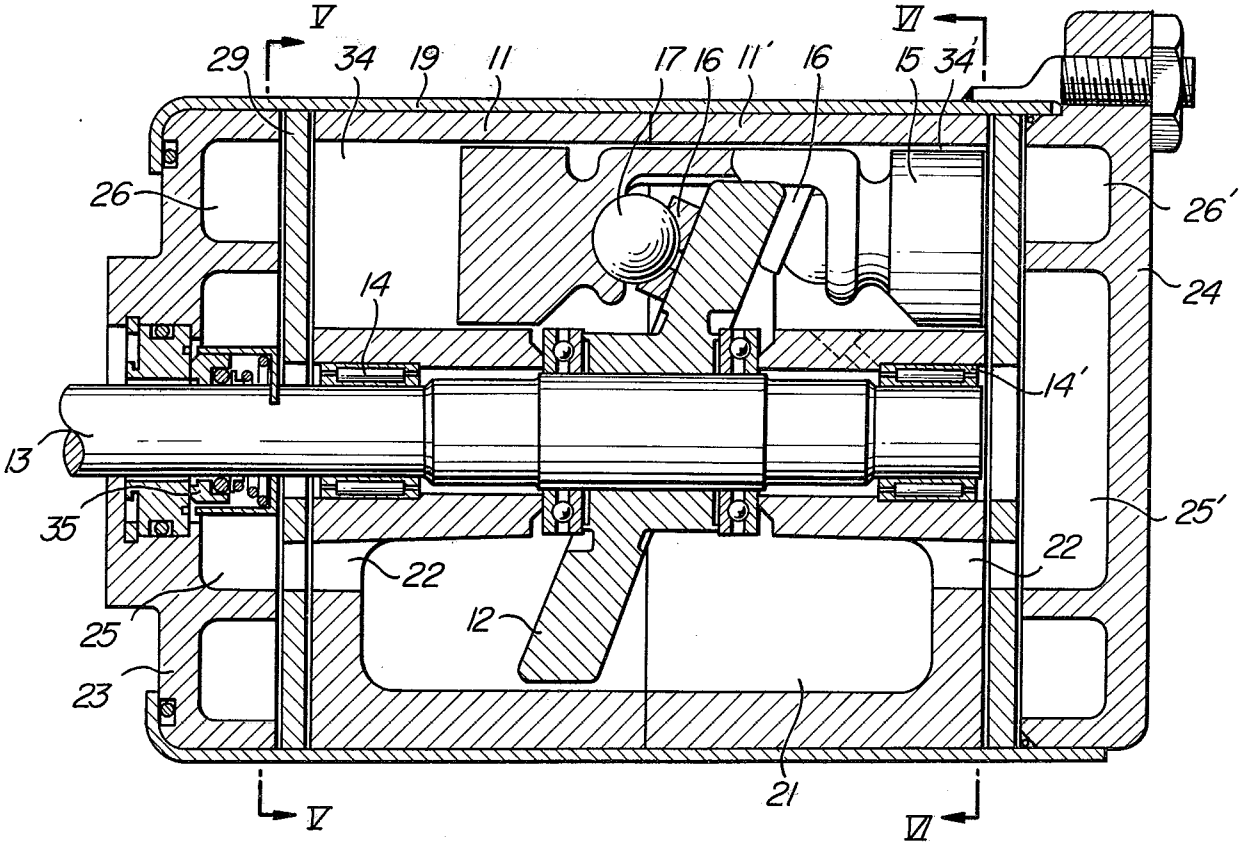
FIG. 2 is a vertical sectional view of a swash plate compressor according to another embodiment of the invention.
Figure 4:
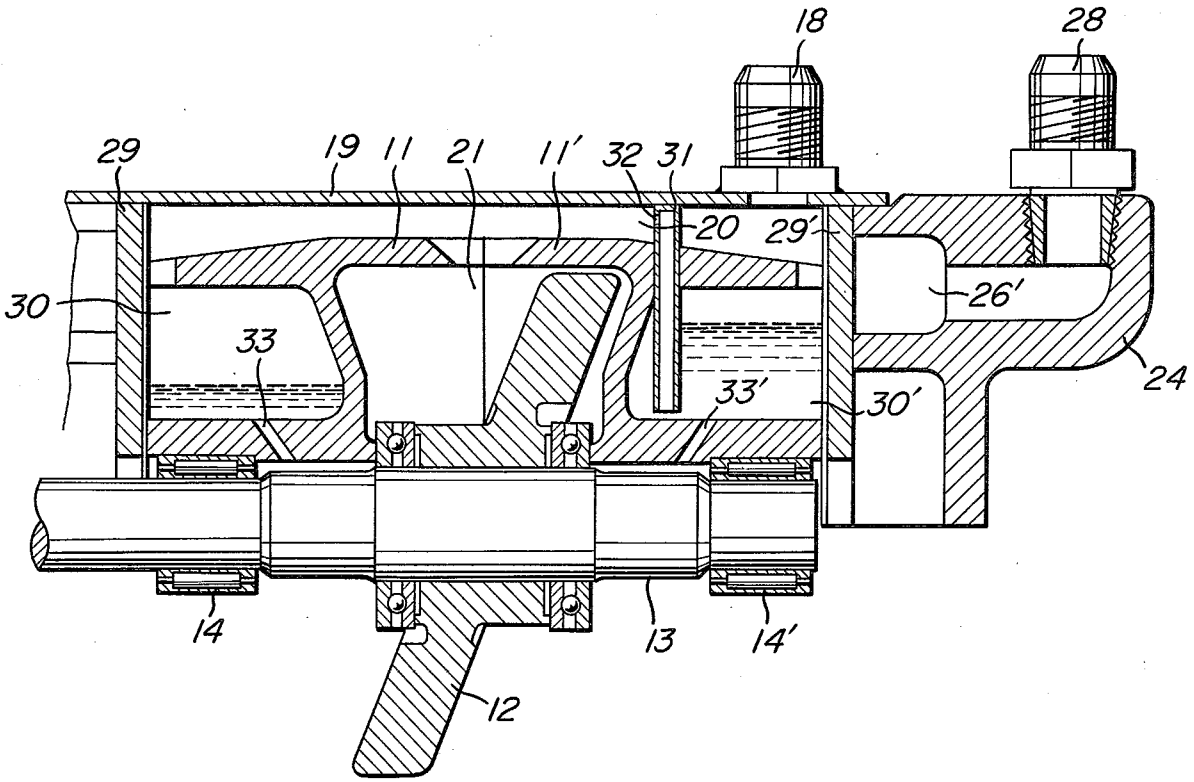
FIG. 4 is a sectional view taken along the line IV — IV of FIG. 3.

The practical construction of the compressor will be described by way of example with reference to FIGS. 2 to 6. As shown in FIG. 2, the compressor includes a pair of opposed cylinder blocks 11, 11' arranged on both sides of a swash plate 12 and retained in a shell 19. The swash plate 12 is fixedly mounted on a drive shaft 13 which is rotatably supported by bearings 14, 14' mounted in said cylinder blocks. The rotation of the drive shaft 13 is transformed into a reciprocal motion of a piston 15, slidably disposed in cylinder chamber 34, 34' of the cylinder blocks, through sliding members 16 and a steel ball 17. A refrigerant gas flows into a crank case 21 of the compressor from a suction pipe 18 through a low pressure passage 20 defined by the cylinder block 11' and shell 19 (FIG. 4) and thence into low pressure chambers 25, 25', formed in front cover 23 and a rear cover 24 respectively, through low pressure passages 22 formed in the cylinder blocks 11, 11' and cylinder heads 29, 29'. Thereafter, the refrigerant gas is sucked into the cylinder chambers 34, 34' and compressed thereby the reciprocating piston 15. The compressed high pressure gas is discharged into high pressure chambers 26, 26' and the high pressure gas collected in the high pressure chamber 26 flows into the high pressure chamber 26' through a high pressure passage 27 formed in the cylinder blocks 11, 11' to be discharged from a discharge pipe 28.

When the refrigerant gas flow in the suction pipe 18 is deflected into the low pressure passage 20, the refrigerant gas is separated into refrigerant and oil due to the difference in force of inertia between said refrigerant and oil, and the oil separated from the refrigerant flows into a small oil chamber 30' defined by the cylinder block 11' and cylinder head 29'. This oil chamber is communicated with the low pressure passage through a pipe 31. The pipe 31 is formed therein with a small hole 32 open in the low pressure passage 20 toward the downstream side of said passage. Therefore, when the gaseous refrigerant passes in the low pressure passage 20, a negative pressure appears in the vicinity of the small hole 32 of the pipe 31, and the oil is sucked into said passage from the oil chamber 30' under the effect of said negative pressure and thence into the crank case 21 in an atomized state, together with the gaseous refrigerant, and sprayed over the swash plate 12, the sliding members 16 and the steel ball 17 to lubricate the same. In this case, the lubricating oil is not in the form of liquid but in the form of fog, and is sprayed over the entire surfaces of the sliding members, together with the cold gaseous refrigerant, so that the quantity of oil necessary for lubrication can be very small (several c.c./hr). On the other hand, lubrication of the bearing 14' is achieved by the oil supplied thereto from the oil chamber 30' through a narrow passage 33'. The oil which has not been separated from the gaseous refrigerant is accumulated in an oil chamber 30 on the front side supplied therefrom through a narrow passage 33 to the bearing 14 to lubricate the same. The oil used for lubrication is sucked into the cylinder chambers 34, 34' and again discharged into the refrigeration circuit through the high pressure passage 27 and discharge pipe 28, along with the compressed gas, to be recycled to the suction pipe 18. In this case, the quantity of oil discharged into the refrigeration circuit is so small, unlike that in the conventional refrigerating machine, that such troubles as oil hammer and valve breakage do not occur.

Figure 7:
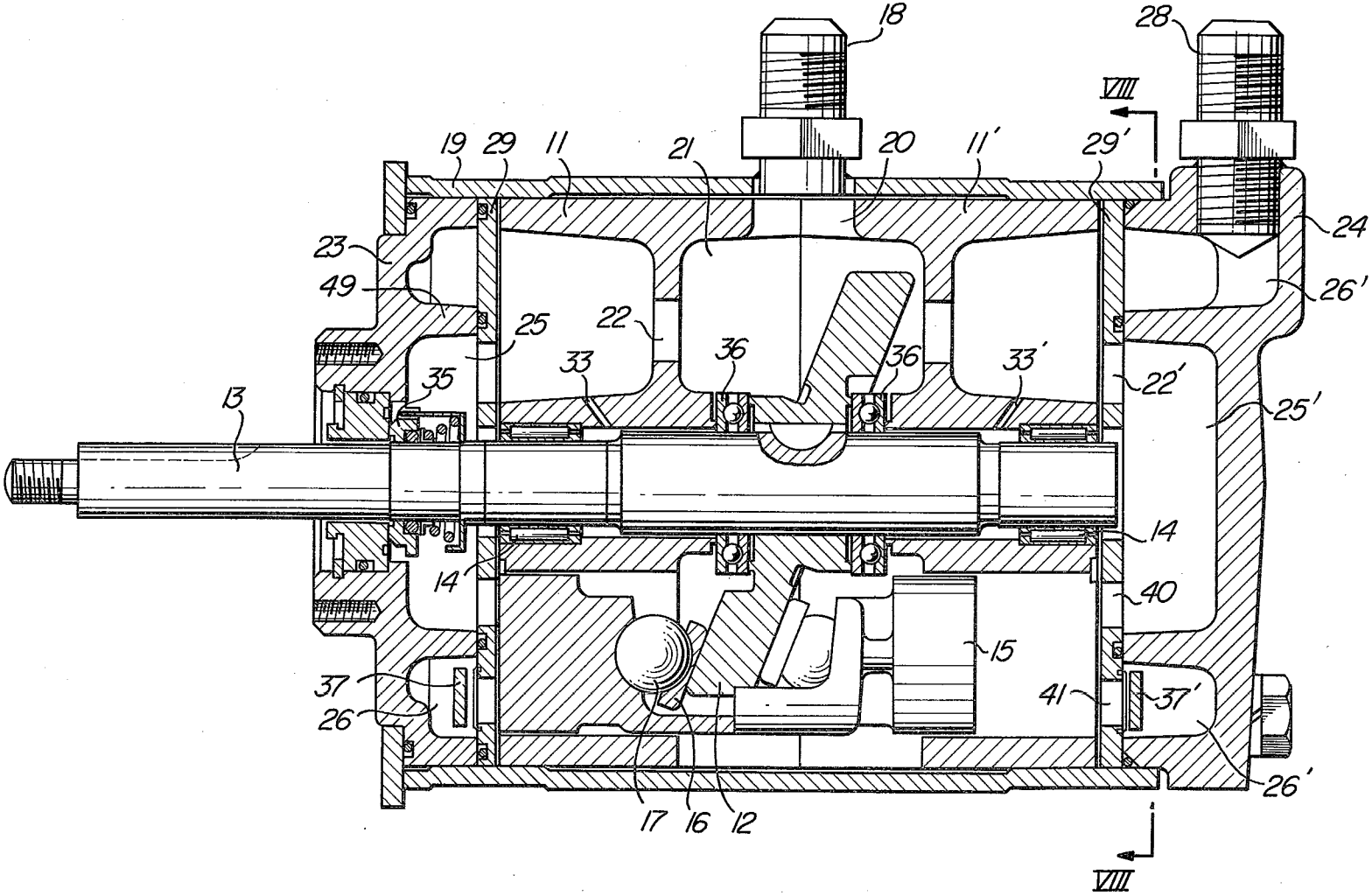
FIG. 7 is a vertical sectional view of a swash plate compressor according to another embodiment of the invention.
Figure 8:
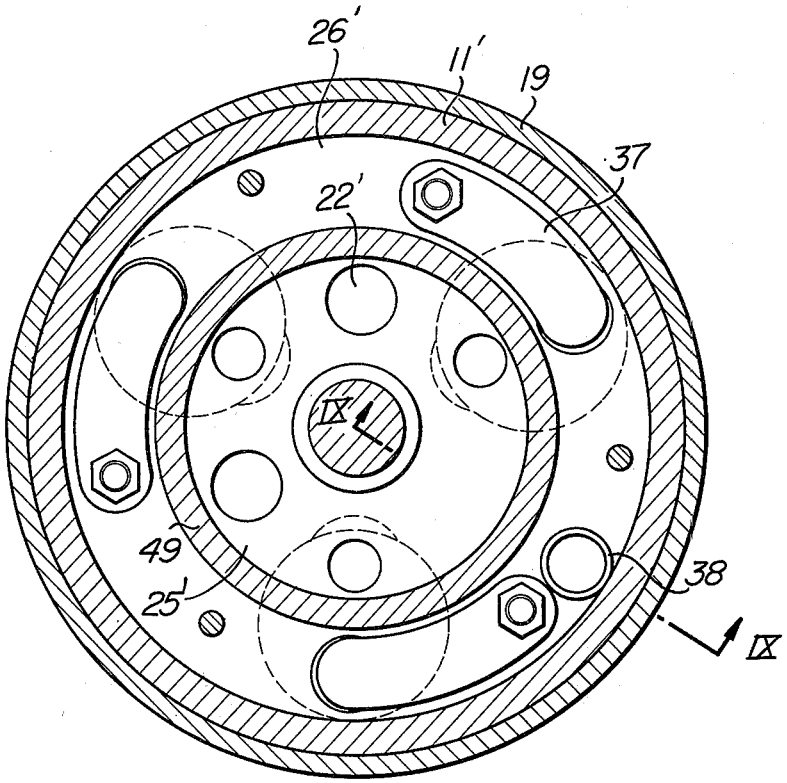
FIG. 8 is a sectional view taken along the line VIII — VIII of FIG. 7.
Figure 9:
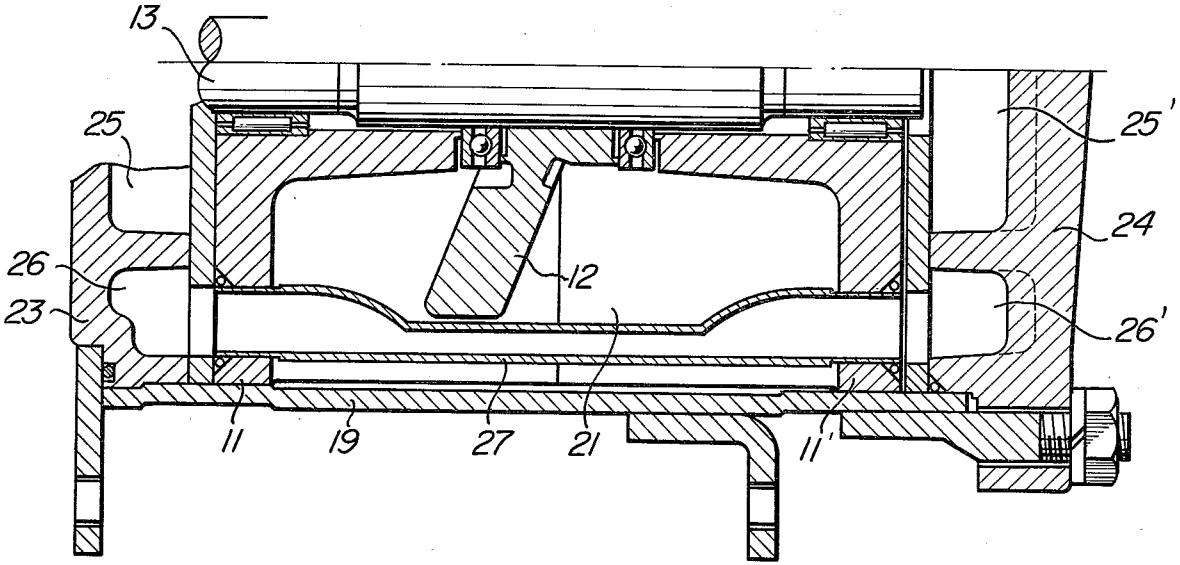
FIG. 9 is a sectional view taken along the line IX — IX of FIG. 8.

Another embodiment of the present invention is shown in FIGS. 7 to 9. In this embodiment, a suction pipe 18 is provided near the center of a shell 19 in communication with a crank case 21, and low pressure passages 22, 22' are formed in cylinder blocks 11, 11' in a manner to communicate the crank case 21 with a low pressure chamber 25. According to such a construction, the direction and cross sectional area of a refrigerant gas flow, sucked into the compressor from the suction pipe 18, change abruptly during passage in the low pressure passages 20, 22, 22' within the crank case 21 and thereby the oil is effectively separated from the gaseous refrigerant. The separated oil is sprayed over the engaging portions of sliding members 16 and a swash plate 12, steel balls 17, thrust bearings 36 and radial bearings 14 to lubricate the same. Further, the engaging portions of the swash plate 12 and sliding members 16, where heat is generated most, are directly cooled by the cold gaseous refrigerant and maintained at a low temperature.

Figure 5:
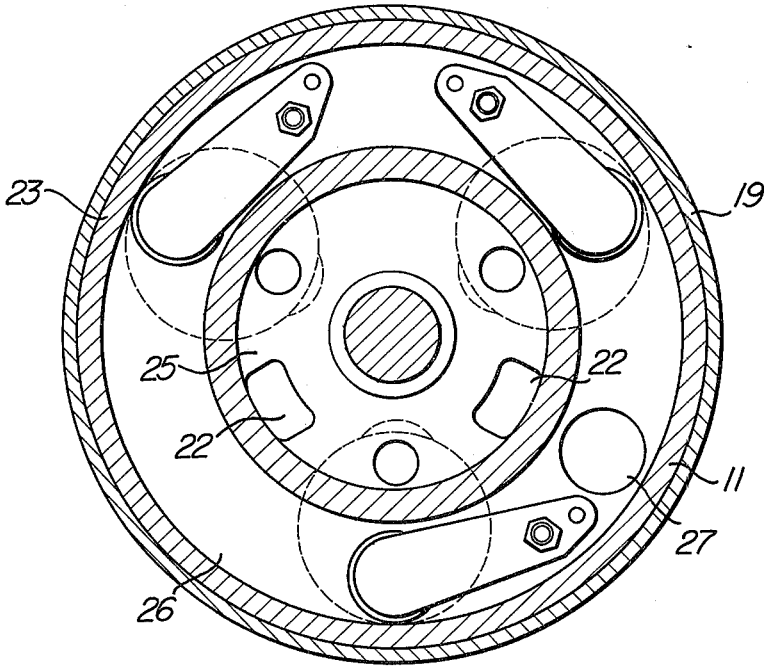
FIG. 5 is a sectional view taken along the line V — V of FIG. 2.
Figure 6:
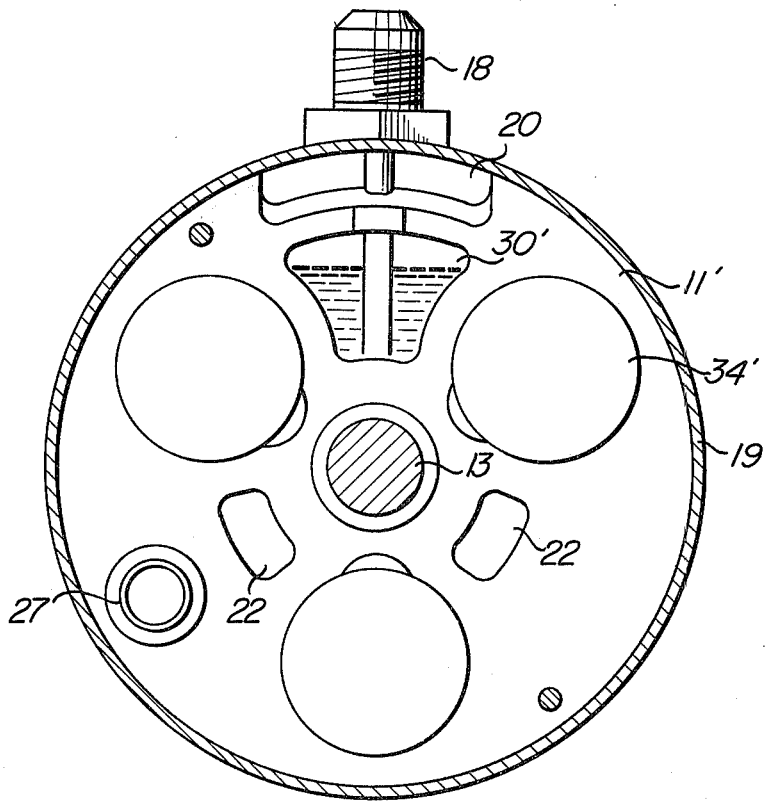
FIG. 6 is a sectional view taken along the line VI — VI of FIG. 2.

A swash plate compressor employing the fog lubrication method, like that of the present invention is operable without a gear pump which is necessary in the other types of compressor employing the forced lubrication method. In addition, the cold lubricating oil in the form of fog can be uniformly widely distributed over the entire areas of the sliding portions and the sliding portions are concurrently cooled, which is particularly advantageous when the compressor operates at a high speed. Furthermore, since the shaft sealing portion 35 need not be isolated from the low pressure chamber 25 formed in the front cover 23, the low pressure chambers 25, 25' and high pressure chambers 26, 26' defined by the front cover 23 and rear cover 24, can be formed in concentrical cylindrical shapes respectively, as shown in FIG. 5. This is extremely advantageous from the manufacture point of view and enables the cost of manufacture to be substantially reduced. Namely, these chambers can be formed simply by providing a circular partition wall 49 on inner surfaces of the cylindrical front and rear covers 23, 24 and, therefore, the front and rear covers can be fabricated by forging. (The front and rear covers of the conventional compressor of this type have been shaped by casting.) Accordingly, the cost of manufacture can be reduced. It is also to be noted that the cylinder blocks 11, 11' and cylinder heads 29, 29' are interchangeable respectively, as they are the same in configuration. The facts that a gear pump and an oil pipe are not necessary and that the portions which need to be carefully fabricated with accuracy, such as a gear pump chamber and an oil passage hole in the drive shaft, are eliminated, also contribute to the cost reduction. A further advantage to be noted is that a mechanical chamber 51 (FIG. 11) for receiving a mechanical seal 35 can also be eliminated as well as the gear pump and, therefore, the volumes of the low pressure chambers 25, 25' and high pressure chambers 26, 26' can be increased without increasing the outer diameter of the compressor. This is advantageous, for a compressor having more or less three cylinder chambers, respectively corresponding to high and low pressure chambers, in suppressing a pulsation of refrigerant gas being sucked in and discharged from the compressure and in enhancing the compression efficiency and reducing noises of the compressor thereby.

Swash plate compressors are frequently used in car coolers and car air conditioners, and the compressor of the present invention which does not have an oil pan is highly adapted for use in such equipments since it can be provided in a cylindrical outer shape and can be mounted at any angle within a narrow engine room.

Figure 10:
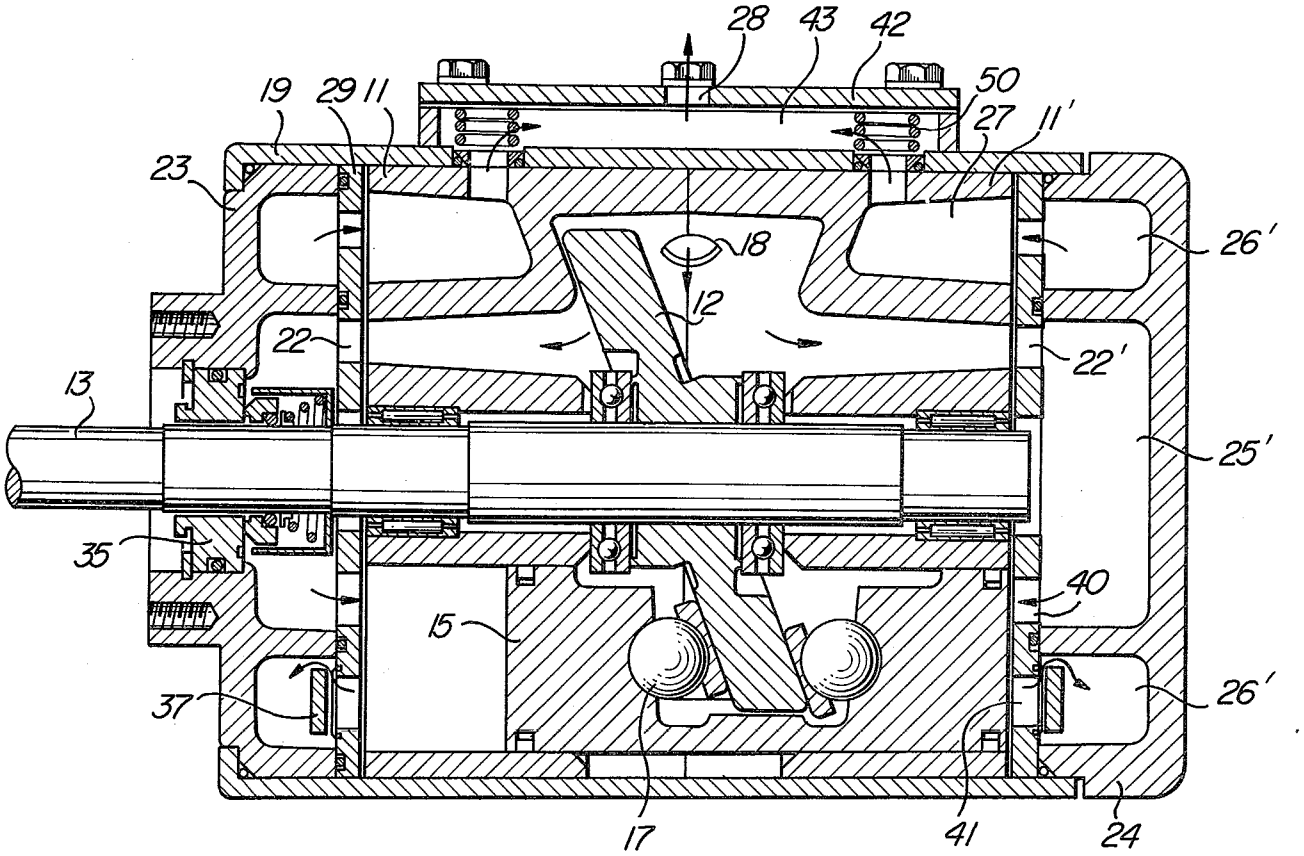
FIG. 10 is a vertical sectional view of a swash plate compressor according to still another embodiment of the invention.

Still another embodiment of the invention is shown in FIG. 10. In this embodiment, its characteristic feature lies in the construction of high pressure passage 27. Namely, a discharge pipe 28 is provided near the center of a shell 19, as well as a suction pipe 18, and the high pressure passage 27 is formed by making use of portions of cylinder blocks 11, 11'. On the other hand, a silencer chamber 43 is formed between a cover 42, fixed to the outer surface of the shell 19, and the shell 19. This silencer chamber 43 is communicated with the high pressure passage 27 through coil springs 50. According to such a construction, the cross-sectional area of the high pressure chamber 27 can be made large and, therefore, a pulsation of the discharge pressure can be alleviated. The high pressure passage having such a large cross-sectional area, in combination with the effect of the silencer chamber 43, also brings about a remarkable noise reducing effect.

I claim:

1. A compressor for refrigerating machines, comprising: a cylindrical shell, a pair of opposed cylinder blocks inserted into said cylindrical shell, cylinder chambers formed in said cylinder blocks, a plurality of pistons slidably disposed in said cylinder chambers, cylinder heads each of which is in the shape of a disk, a drive shaft extending centrally of the cavities of said cylinder blocks, a front and a rear cover fixed to opposite sides of said cylinder blocks, said front and rear covers each being in the shape of a cup having a double-wall structure, the double-walls of a respective cover being formed concentric with said drive shaft, low pressure chambers and high pressure chambers formed between said cylinder heads and said front and rear covers respectively and separated from each other by circular partition walls, passage means communicating the low pressure chambers with the cylinder chambers through suction openings, passage means communicating the high pressure chambers with the cylinder chambers through discharge openings, one end of the drive shaft facing the low pressure chamber provided in the rear cover, the other end of the drive shaft extending through the low pressure chamber in the front cover toward the outside of the front cover, shaft sealing means mounted within the low pressure chamber in the front cover to permit low pressure refrigerant containing lubrication oil to flow about the periphery of said shaft sealing means and into said cylinder chambers through said passage means communicating the low pressure chamber in the front cover with said cylinder chambers, a swash plate disposed within a crank case formed in the cylinder blocks and operatively connected with said pistons, a suction pipe connecting the suction side of the compressor with a refrigeration circuit, a low pressure passage communicating the suction pipe with the crank case and further communicating the crank case with the low pressure chambers, a discharge pipe and a high pressure passage communicating the high pressure chambers with the discharge pipe, said cylinder heads and said front and rear covers being inserted into the shell from the opposite sides of the cylinder blocks to form concentric inner and outer chambers between each cylinder head and said front and rear cover, respectively, said inner chamber constituting a low pressure chamber and said outer chamber constituting a high pressure chamber.

2. A compressor for refrigerating machines, as defined in claim 1, wherein sliding members are provided between said swash plate and said pistons and thrust bearing portions are provided between said swash plate and said cylinder blocks, said suction pipe being connected with said shell at a position substantially equidistant from said front and rear covers whereby a refrigerant flowing through said suction pipe is fed to said sliding members and said thrust bearing portions.

* * * * *